US009172162B2

(12) United States Patent
Mostoller et al.

(10) Patent No.: US 9,172,162 B2
(45) Date of Patent: Oct. 27, 2015

(54) CIRCUIT BOARD CONNECTOR

(71) Applicant: Tyco Electronics Corporation, Berwyn, PA (US)

(72) Inventors: Matthew Edward Mostoller, Hummelstown, PA (US); Ronald Martin Weber, Annville, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 63 days.

(21) Appl. No.: 14/188,203

(22) Filed: Feb. 24, 2014

(65) Prior Publication Data

US 2015/0244090 A1 Aug. 27, 2015

(51) Int. Cl.
*H01R 13/73* (2006.01)
*H01R 12/71* (2011.01)
*H01R 12/70* (2011.01)

(52) U.S. Cl.
CPC ..... *H01R 12/714* (2013.01); *H01R 12/7047* (2013.01)

(58) Field of Classification Search
CPC ..... H01R 23/7042; H01R 23/7073
USPC ..... 439/573, 682, 79, 78, 660, 507, 439/510–512, 825, 907, 947
See application file for complete search history.

(56) References Cited

U.S. PATENT DOCUMENTS

| | | | | |
|---|---|---|---|---|
| 5,158,471 | A * | 10/1992 | Fedder et al. | 439/80 |
| 6,203,335 | B1 * | 3/2001 | Chang | 439/79 |
| 6,780,027 | B2 * | 8/2004 | Allison | 439/79 |
| 6,832,931 | B1 * | 12/2004 | Wu | 439/499 |
| 6,848,950 | B2 * | 2/2005 | Allison et al. | 439/682 |
| 2009/0191725 | A1 | 7/2009 | Vogt et al. | |
| 2012/0156920 | A1 | 6/2012 | Sakai et al. | |
| 2013/0176708 | A1 | 7/2013 | Mostoller | |

FOREIGN PATENT DOCUMENTS

EP 2 570 721 A1 3/2013

OTHER PUBLICATIONS

International Search Report, International Application No. PCT/US2015/016513, International Filing Date, Feb. 19, 2015.

* cited by examiner

*Primary Examiner* — Phuongchi T Nguyen

(57) ABSTRACT

A circuit board connector includes a contact having a mating end with a spring beam having a separable mating interface and a terminating end configured to be terminated to a wire. A housing holds the contact and includes a main body extending between a front and a rear. The housing has a mounting flange extending from the main body. The main body has a contact channel holding the contact and a wire barrel at the front configured to receive the wire. The rear of the main body is positionable on the circuit board such that the spring beam of the contact is aligned with the contact pad. A fastener is coupled to the mounting flange and is used to secure the housing to a substrate independent of the circuit board.

20 Claims, 6 Drawing Sheets

CIRCUIT BOARD CONNECTOR

BACKGROUND OF THE INVENTION

The subject matter herein relates generally to circuit board connectors.

Circuit boards have many applications, including lighting applications where LEDs are mounted on the circuit board. To provide power to the circuit boards, wires are typically soldered to pads on the circuit board, which is time consuming and does not lend itself to automation. Some known applications use connectors or headers mounted to the circuit boards with mating connectors terminated to ends of power cables that are plugged into the connectors or headers on the circuit board. Such applications increase the overall cost by requiring two complementary connector halves that must be assembled and then later mated together. Additionally, the connectors or headers are typically soldered to the circuit board and a supplier of such connectors and circuit boards may need to keep a supply of different circuit boards with different connector options in stock to achieve different final end applications.

A need remains for a cost effective and reliable system for connecting wires to circuit boards.

BRIEF DESCRIPTION OF THE INVENTION

In one embodiment, a circuit board connector is provided that includes a contact having a mating end and a terminating end. The mating end has a spring beam having a separable mating interface configured to be surface mounted to a contact pad of a circuit board. The terminating end is configured to be terminated to a wire. A housing holds the contact. The housing has a main body extending between a front and a rear overlapping the circuit board with the front hanging off the circuit board. The front has a mounting flange extending from the main body. The main body has a contact channel holding the contact and a wire barrel at the front configured to receive the wire. The rear of the main body is positionable on the circuit board such that the spring beam of the contact is aligned with the contact pad. A fastener is coupled to the mounting flange and is used to secure the housing to a substrate independent of the circuit board.

Optionally, the contact may define a direct electrical path between the wire and the contact pad of the circuit board. The contact may be a poke-in contact having a lance or another type of contact that mechanically and electrically connects to the wire. The housing may be pressed against the circuit board when the fastener is secured to the substrate to compress the contact against the contact pad. The fastener may be a screw or other securing feature. Optionally, the mounting flange and the fastener may be located off of the circuit board.

Optionally, the housing may have a second mounting flange extending from the housing opposite the mounting flange. The housing may include an alignment element engaging the circuit board to position the housing relative to the circuit board. The alignment element may be a ledge extending from a base of the main body. The ledge may engage an edge of the circuit board.

Optionally, the main body may include a base at the rear mounted to the circuit board. The spring beam may be exposed at the base for mounting to the circuit board. The wire barrel may extend along a wire barrel axis. The wire barrel axis may be oriented parallel to the base. The wire barrel axis may be oriented perpendicular to the base. The wire barrel may receive the wire from below the base. The wire barrel may receive the wire from above the base.

In another embodiment, a circuit board connector system is provided that includes a circuit board having a front side and a rear side. The rear side is configured to be mounted to a mounting surface of a substrate. The front side may have a contact pad. The circuit board may have one or more LEDs terminated to the front side and electrically connected to the contact pad. A circuit board connector is coupled directly to the circuit board. The circuit board connector includes a contact having a mating end and a terminating end. The mating end has a spring beam having a separable mating interface configured to be surface mounted to a contact pad of a circuit board. The terminating end is configured to be terminated to a wire. A housing holds the contact. The housing has a main body extending between a front and a rear overlapping the circuit board with the front hanging off the circuit board. The front has a mounting flange extending from the main body. The main body has a contact channel holding the contact and a wire barrel at the front configured to receive the wire. The rear of the main body is positionable on the circuit board such that the spring beam of the contact is aligned with the contact pad. A fastener is coupled to the mounting flange and is used to secure the housing to the substrate independent of the circuit board.

DETAILED DESCRIPTION OF THE INVENTION

Figure 1:
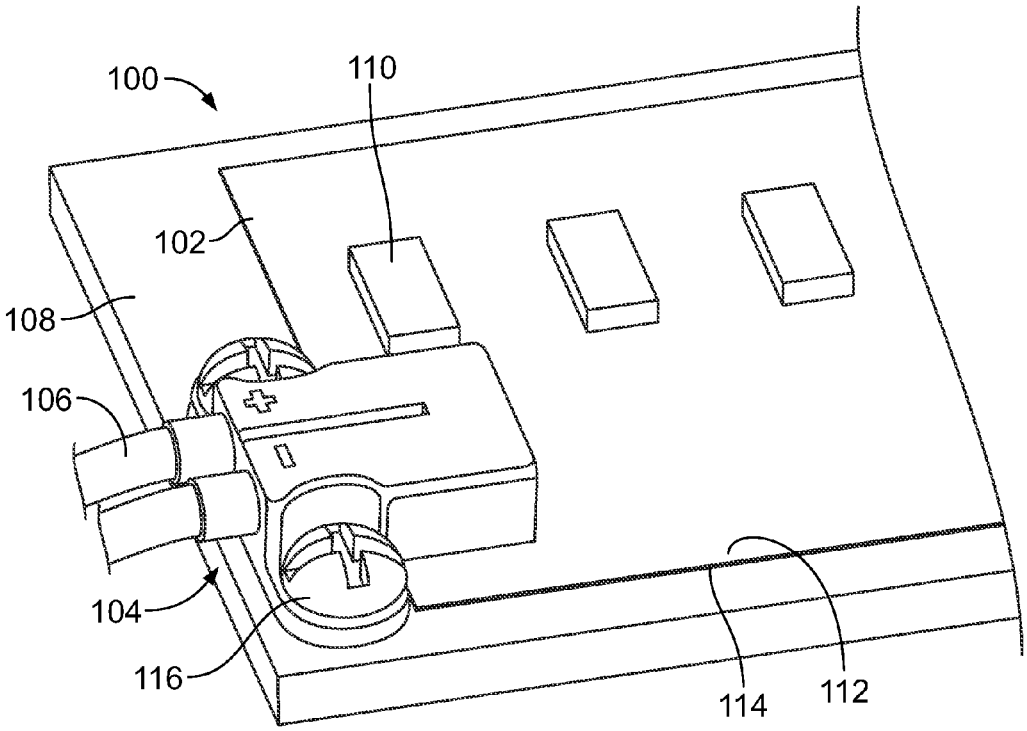
FIG. 1 is a front perspective view of a circuit board connector system formed in accordance with one embodiment.

FIG. 1 is a front perspective view of a circuit board connector system 100 formed in accordance with one embodiment. The connector system 100 includes a circuit board 102, which may be a rigid circuit board or a flexible circuit board. The connector system 100 includes a circuit board connector 104, or simply connector 104, electrically coupled to the circuit board 102. Cables or wires 106 are directly terminated to the connector 104 and the connector 104 is used to electrically connect the wires 106 with the circuit board 102. Power, for example, may thus be supplied directly from the wires 106 to the circuit board 102 by the connector 104. The circuit board 102 is configured to be mounted to a mounting surface of a substrate 108. For example, the substrate 108 may be a heat sink in various embodiments. The mounting surface of the substrate 108 may be planar, or alternative may be non-planar, such as a curved surface.

In an exemplary embodiment, the connector 104 is a poke-in type of connector, where the wires 106 are coupled to the connector 104 by a simple poke-in wire termination. The poke-in termination offers quick and reliable wire termination as a low-labor alternative to hand-soldering of the wires 106 either directly to the circuit board 102 or to a contact or other component.

In an exemplary embodiment, the connector system 100 may be part of a lighting system, such as an LED lighting system. For example, one or more LEDs 110 may be mounted to the circuit board 102. The connector 104 may be electrically connected to the LEDs 110 by traces on the circuit board 102. The connector 104 supplies power and/or control functions to the LEDs 110. The wire 106 supplies power and/or control signals to the connector 104. The connector system 100 may have use in other fields or for other applications in alternative embodiments other than supplying power to LEDs.

The circuit board 102 includes a front side 112 and a rear side 114. The LEDs 110 are provided along the front side 112, but may be provided along the rear side 114 in addition or in the alternative to the front side 112. The rear side 114 may be secured to the substrate 108, such as using fasteners, an adhesive layer, such as double sided tape, and the like. Optionally, the front side 112 may be upward facing and the rear side 114 may be downward facing; however other orientations are possible in alternative embodiments. Optionally, the circuit board 102 may dissipate heat to the substrate 108, which may be a heat sink, to dissipate heat from the LEDs 110. The connector 104 may contribute normal force to the circuit board 102 to ensure thermal transfer to the heat sink.

The connector 104 is mechanically connected to the substrate 108 independent from the circuit board 102. The connector 104 is secured to the substrate 108 using fasteners 116. In the illustrated embodiment, the fasteners 116 are threaded screws, however other types of fasteners 116 may be used in alternative embodiments, such as clips, latches, solder tabs, and the like. The fasteners 116 pass through the connector 104 outside of the circuit board 102 such that the fasteners 116 do not pass through the circuit board 102. Mounting the connector 104 to the substrate 108 may help secure the circuit board 102 to the substrate 108; however the fasteners 116 do not pass through the circuit board 102. For example, the connector 104 may be provided along an edge of the circuit board 102 and the connector 104 may secure such edge of the circuit board 102 to the substrate 108. In alternative embodiments, the fasteners 116 may pass through both the circuit board 102 and the connector 104 to secure both the connector 104 and the circuit board 102 to the substrate 108. In other alternative embodiments, the connector 104 may be provided away from the edge of the circuit board 102, such as near a middle of the circuit board 102. The connector 104 may be above the circuit board 102 or below the circuit board 102, such as between the substrate 108 and the circuit board 102.

Contact pads (shown in FIG. 4) are provided along the circuit board 102. In the illustrated embodiment, the contact pads are provided along the front side 112; however the contact pads may be along the rear side 114. The contact pads are electrically connected to traces of the circuit board 102 and are routed to the LEDs 110 (shown in FIG. 1). The connector 104 may have a low profile so that the connector 104 does not detrimentally affect the lighting of the LEDs 110. The connector 104 is configured to be electrically connected to the contact pads to transfer the power from the wires 106 to the circuit board 102. The contact pads define separable mating interfaces for the connector 104.

Figure 2:
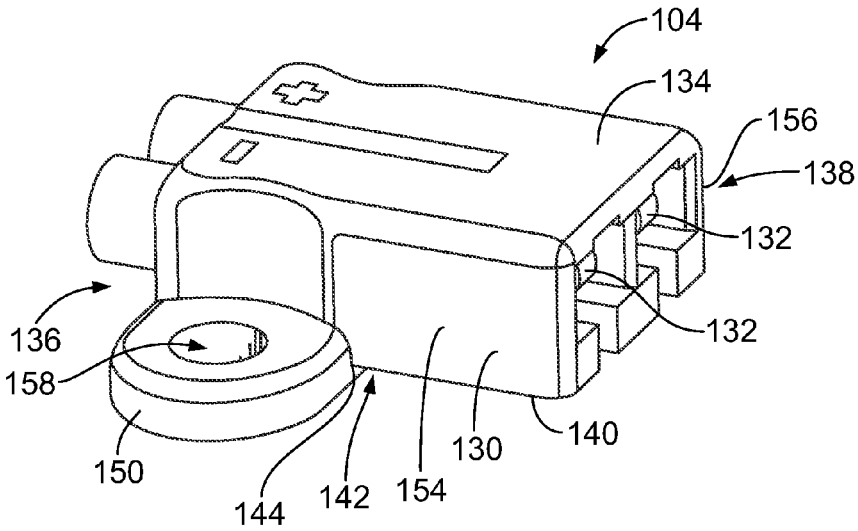
FIG. 2 is a rear perspective view of a circuit board connector for the system and formed in accordance with an exemplary embodiment.
Figure 3:
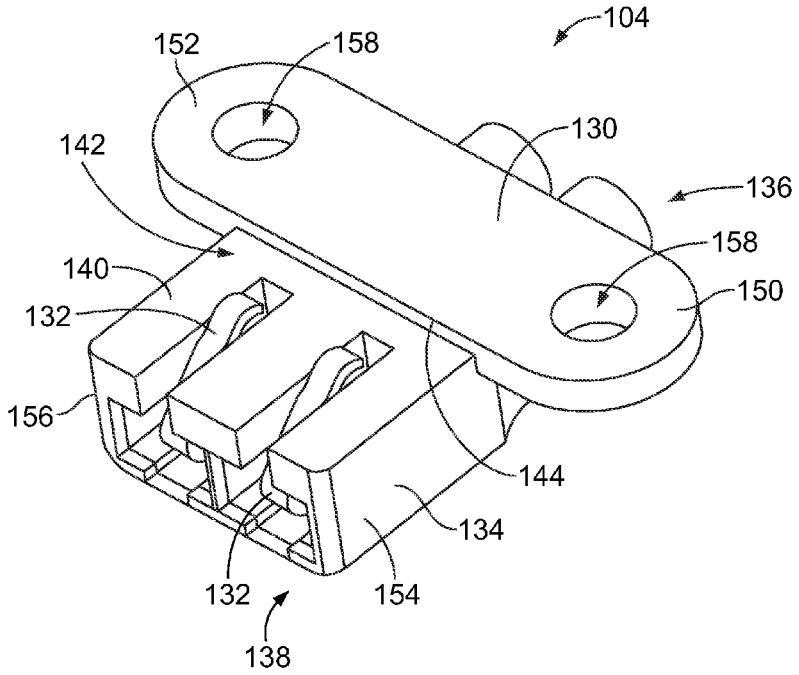
FIG. 3 is a bottom perspective view of the circuit board connector.

FIG. 2 is a rear perspective view of the circuit board connector 104 formed in accordance with an exemplary embodiment. FIG. 3 is a bottom perspective view of the circuit board connector 104. Various features and aspects of the connector 104 will be described with reference to FIGS. 2 and 3, with additional reference to FIG. 1.

The connector 104 includes a housing 130 that holds one or more contacts 132 that directly connect the wires 106 with corresponding contact pads (FIG. 1). In the illustrated embodiment, the contacts 132 are poke-in contacts, and may be referred to hereinafter as poke-in contacts 132, however other types of contacts may be used in alternative embodiments, such as crimp contacts, insulation displacement contacts, and the like.

In an exemplary embodiment, the housing 130 includes and/or is formed from a dielectric material, such as a plastic material. The housing 130 includes a main body 134 that holds the contacts 132. The main body 134 extends between a front 136 and a rear 138. The rear 138 is the portion of the main body 134 that overlaps the circuit board 102, while the front 136 is the portion of the main body that hangs off the circuit board 102, such as for mounting to the substrate 108.

The main body 134 includes a base 140 that faces the circuit board 102. The base 140 at the rear 138 may engage the circuit board 102 and hold the circuit board 102 against the substrate 108. For example, when the connector 104 is coupled to the circuit board 102 by the fasteners 116, the base 140 may be pressed against the circuit board 102. The contacts 132 are exposed along the base 140 and engage the contact pads when the housing 130 is pressed against the circuit board 102. Optionally, the housing 130 may include a pocket 142 at the base 140 that receives an edge portion of the circuit board 102. The contacts 132 may extend at least partially into the pocket 142 to engage the contact pads when the connector 104 is closed and coupled to the circuit board 102.

An alignment feature 144 may extend into or along the pocket 142. The alignment feature 144 is used to position the connector 104 relative to the circuit board 102. In the illustrated embodiment, the alignment feature 144 is a ledge defining a side of the pocket 142. The edge of the circuit board 102 may abut against the ledge to locate the connector 104 relative to the circuit board 102. Other types of alignment features may be provided in alternative embodiments.

The housing 130 includes mounting flanges 150, 152 extending from opposite sides 154, 156 of the main body 134. The mounting flanges 150, 152 include openings 158 therethrough that receive the fasteners 116. Optionally, the openings 158 may be threaded. The mounting flanges 150, 152 support the connector 104 on the substrate 108. As the fasteners 116 are secured to the substrate 108, the mounting flanges 150, 152 are pulled against the substrate 108. The mounting flanges 150, 152 may have other shapes or sizes in alternative embodiments, such as to accommodate different types of fasteners, such as solder tabs, clips, and the like, used to secure the housing 130 to the substrate 108.

Figure 4:
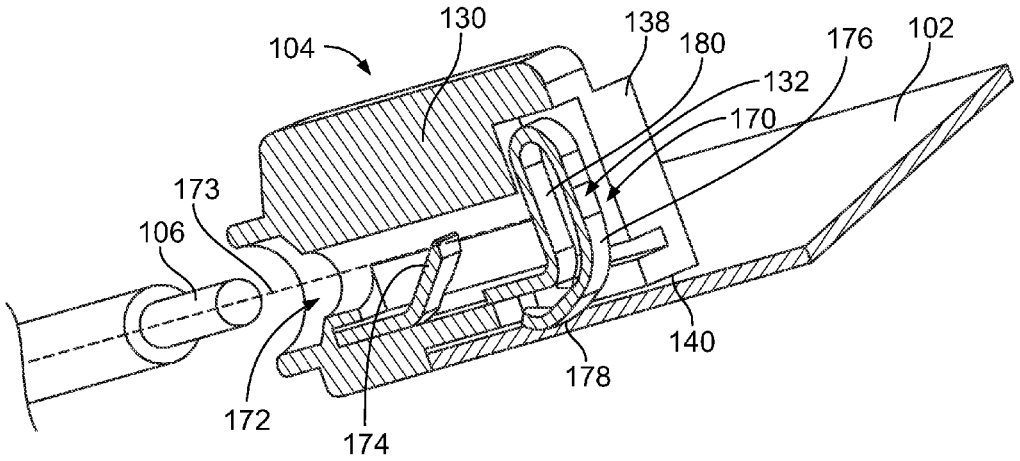
FIG. 4 is a partial sectional view of the circuit board connector and circuit board.

FIG. 4 is a partial sectional view of the circuit board connector 104 and circuit board 102. The contact 132 is received in a corresponding contact channel 170 of the housing 130 and extends into a wire barrel 172 of the housing 130 for termination to the wire 106. The contact channel 170 is sized and shaped to hold the poke-in contact 132. In an exemplary embodiment, the contact channel 170 is open at the rear 138 of the housing 130, such as for loading the contact 132 into the contact channel 170 through the opening at the rear 138. The contact channel 170 is open at the base 140 of the housing 130, such that the contact 132 may be exposed for surface mounting to the corresponding contact pad on the circuit board 102. The contact channel 170 is open to the corresponding wire barrel 172. The wire barrel 172 receives the corresponding wire 106 (shown in FIG. 1) and guides the wire 106 into the contact 132. The wire barrel 172 extends along a wire barrel axis 173. In the illustrated embodiment, the wire barrel axis 173 is oriented generally parallel to the base 140 and to the circuit board 102.

The poke-in contact 132 includes a wire trap, defined by one or more lances 174, which mechanically and electrically connect to the wire 106. The lance 174 is deflectable and may dig into the conductor of the wire 106 to stop the wire from backing out of the housing 130. The lance 174 is electrically connected to the conductor to create an electrical path between the wire 106 and the contact 132. Other types of wire traps or securing features may be used in alternative embodiments to electrically connect the contact 132 to the wire 106.

The contact 132 includes a spring beam 176 having a separable mating interface 178. The spring beam 176 is deflectable and is configured to be resiliently deflected against the contact pad to create an electrical path between the contact 132 and the contact pad. In an exemplary embodiment, the spring beam 176 follows a tortuous path within the housing 130 to provide a long working length for the spring beam 176 to ensure that the spring beam 176 remains spring biased against the contact pad. Optionally, the spring beam 176 may have a blocking portion 180 forward of the wire barrel 172. The blocking portion 180 stops wire insertion into the housing 130. For example, the wire 106 may be inserted into the housing 130 until the wire 106 bottoms out against the blocking portion 180. The contact 132 may have other shapes or features in alternative embodiments.

Figure 5:
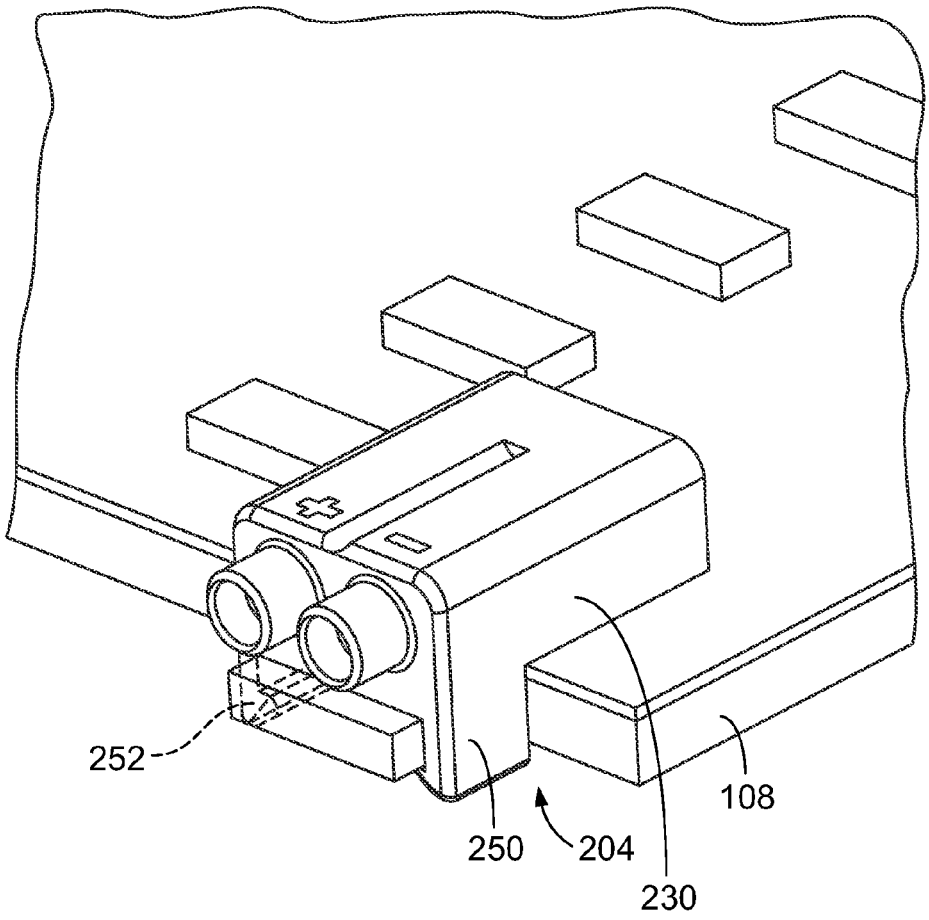
FIG. 5 illustrates a circuit board connector formed in accordance with an exemplary embodiment.

FIG. 5 illustrates a circuit board connector 204 formed in accordance with an exemplary embodiment. The circuit board connector 204 is similar to the connector 104 (shown in FIG. 1); however the connector 204 is secured to the substrate 108 in a different manner. The connector 204 includes mounting flanges 250, 252 extending from a housing 230 of the connector 204. The mounting flanges 250, 252 are deflectable latches used to secure the housing 230 to the substrate 108. The mounting flanges 250, 252 may extend around a portion of the substrate 108 or through holes or openings in the substrate 108, such as to latch to a bottom side of the substrate 108. The mounting flanges 250, 252 eliminate the need for separate fasteners.

Figure 6:
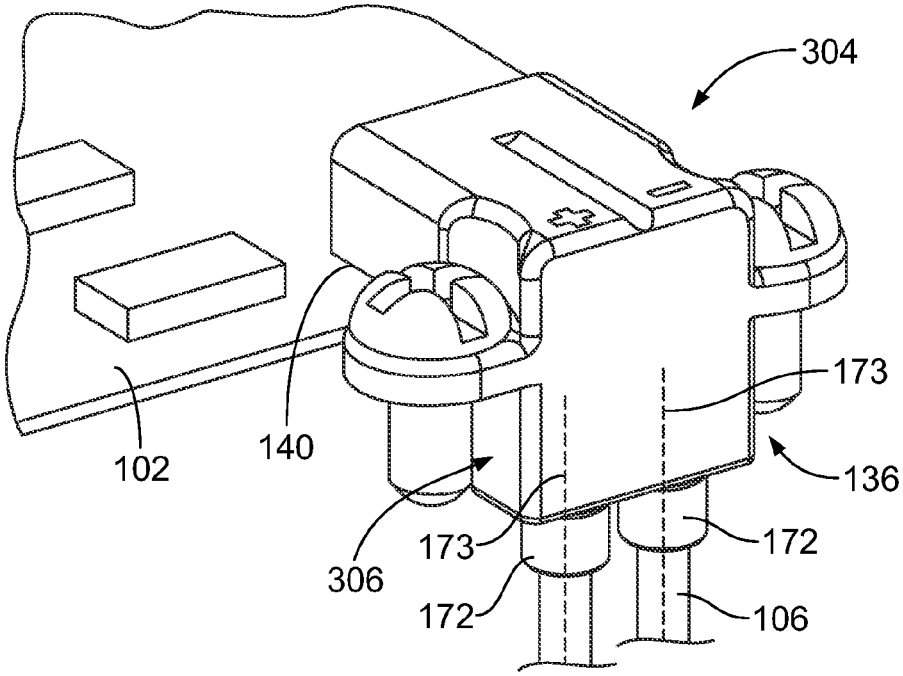
FIG. 6 illustrates a circuit board connector formed in accordance with an exemplary embodiment.
Figure 7:
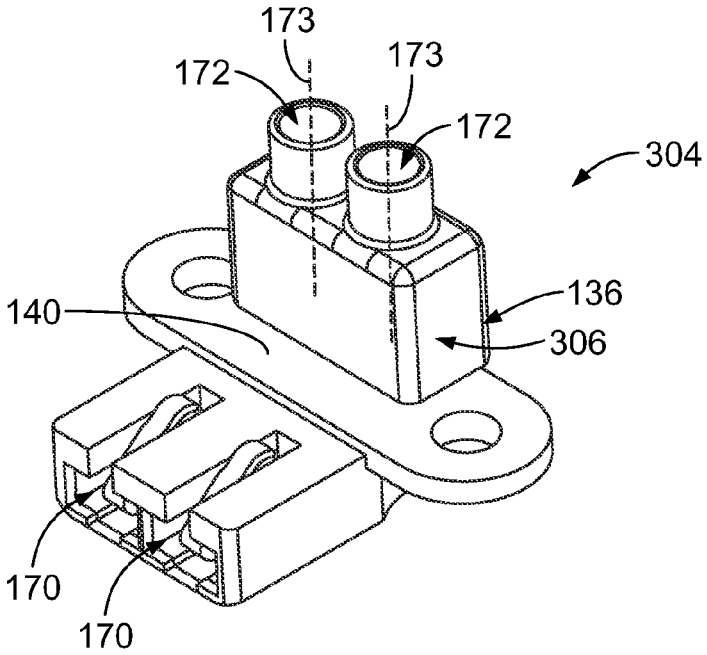
FIG. 7 is a bottom perspective view of the circuit board connector shown in FIG. 6.

FIG. 6 illustrates a circuit board connector 304 formed in accordance with an exemplary embodiment. FIG. 7 is a bottom perspective view of the connector 304. The circuit board connector 304 is similar to the connector 104 (shown in FIG. 1) and like components are identified with like reference numerals. The connector 304 receives the wires 106 in a different direction than the connector 104.

The connector 304 includes an extension 306 extending from the base 140 at the front 136. The extension 306 may extend through the substrate 108 (shown in FIG. 1). The wire barrels 172 extend through the extension 306 and are open to the contact channels 170. The wire barrel axes 173 are orientated generally perpendicular to the base 140 and the circuit board 102. The openings to the wire barrels 172 are positioned below the base 140.

Figure 8:
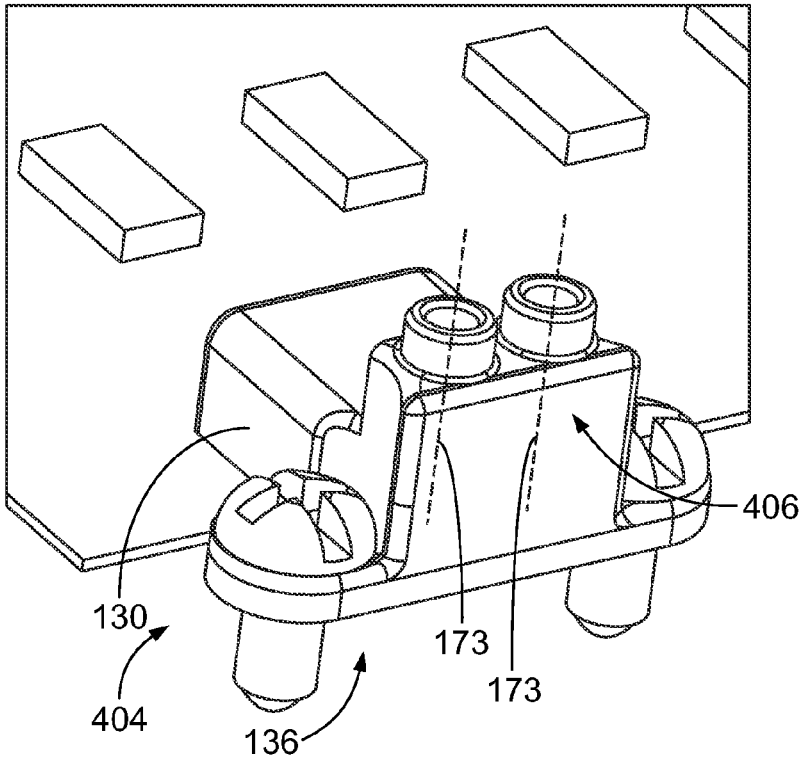
FIG. 8 illustrates a circuit board connector formed in accordance with an exemplary embodiment.
Figure 9:
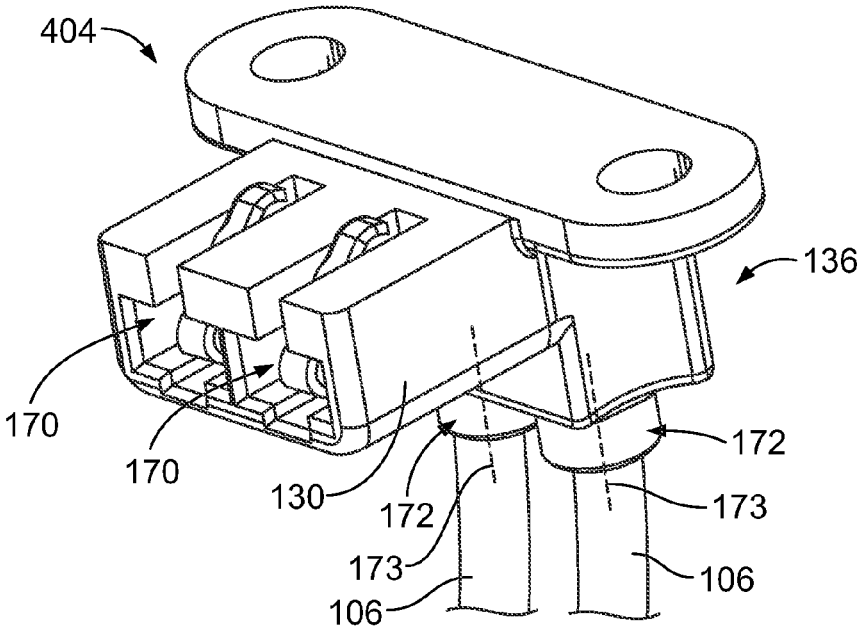
FIG. 9 is a bottom perspective view of the circuit board connector shown in FIG. 8.

FIG. 8 illustrates a circuit board connector 404 formed in accordance with an exemplary embodiment. FIG. 9 is a bottom perspective view of the connector 404. The circuit board connector 404 is similar to the connector 104 (shown in FIG. 1) and like components are identified with like reference numerals. The connector 404 receives the wires 106 in a different direction than the connector 104.

The connector 404 includes an extension 406 extending from the housing 130 at the front 136. The extension 406 extends in an opposite direction as the extension 306 (shown in FIG. 7). The wire barrels 172 extend through the extension 406 and are open to the contact channels 170. The wire barrel axes 173 are orientated generally perpendicular to the base 140 and the circuit board 102. The openings to the wire barrels 172 are positioned above the base 140.

Figure 10:
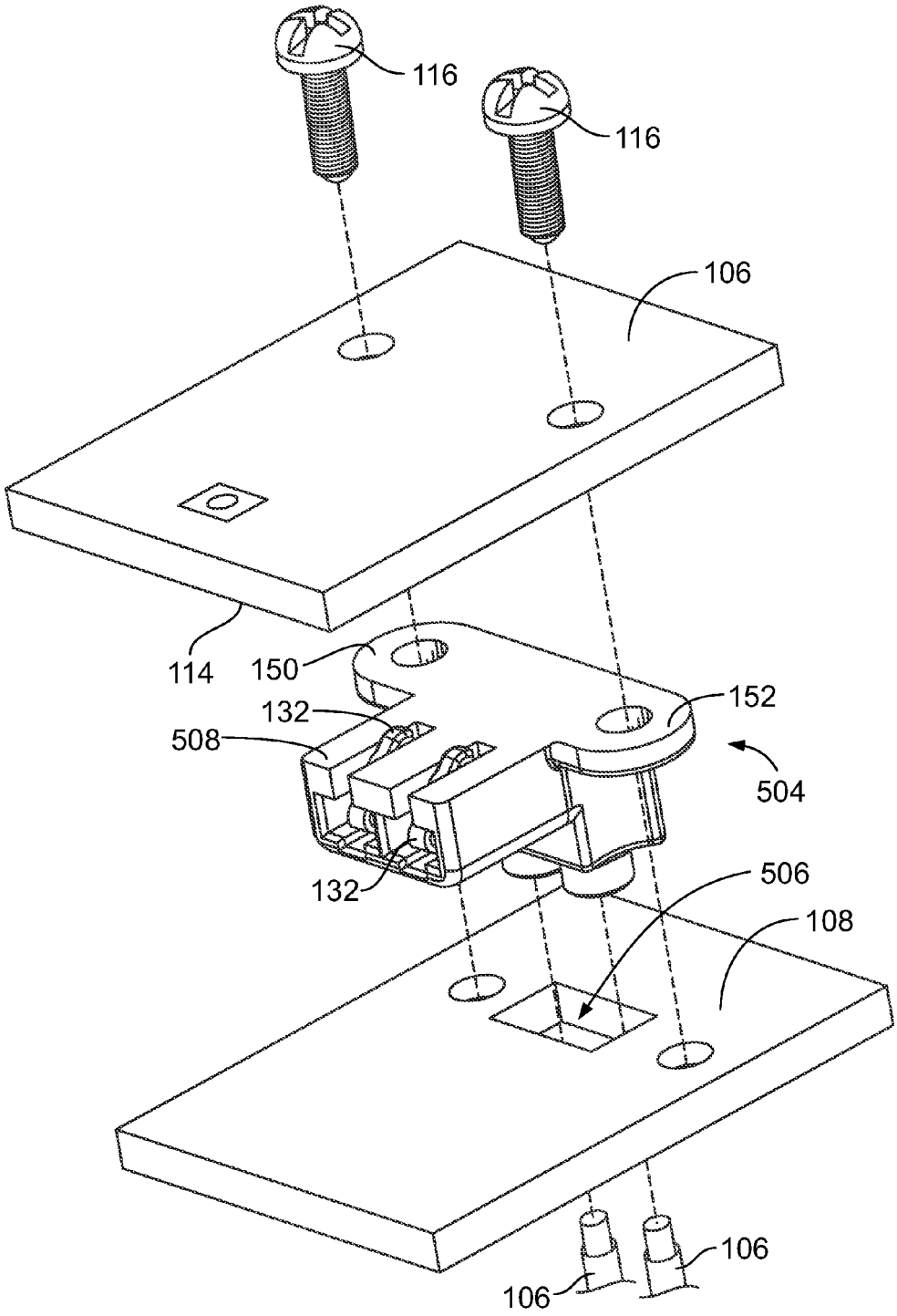
FIG. 10 illustrates a circuit board connector formed in accordance with an exemplary embodiment.

FIG. 10 illustrates a circuit board connector 504 formed in accordance with an exemplary embodiment. The circuit board connector 504 is similar to the connector 104 (shown in FIG. 1) and like components are identified with like reference numerals. The connector 504 is configured to be mounted to the substrate 108, such as through an opening 506 in the substrate 108. The connector 504 is configured to be positioned between the circuit board 106 and the substrate 108. The fasteners 116 pass through the circuit board 106 and the mounting flanges 150, 152 to secure the circuit board 106 and the connector 504 to the substrate 108. The contacts 132 are exposed along a top 508 of the housing 130 to engage a rear side 114 of the circuit board 106 where the contacts 132 are electrically connected to contact pads (not shown) of the circuit board 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A circuit board connector comprising:

a contact having a mating end and a terminating end, the mating end having a spring beam having a separable mating interface configured to be surface mounted to a contact pad of a circuit board, the terminating end being configured to be terminated to a wire;

a housing holding the contact, the housing having a main body extending between a front and a rear, the housing having a mounting flange extending from the main body, the main body including a contact channel holding the contact and a wire barrel at the front configured to receive the wire, the rear of the main body being positionable on the circuit board such that the spring beam of the contact is aligned with the contact pad; and a fastener coupled to the mounting flange, the fastener used to secure the housing to a substrate independent of the circuit board.

2. The circuit board connector of claim 1, wherein the contact defines a direct electrical path between the wire and the contact pad of the circuit board.

3. The circuit board connector of claim 1, wherein the contact comprises a poke-in contact having a lance that mechanically and electrically connects to the wire.

4. The circuit board connector of claim 1, wherein the housing is pressed against the circuit board when the fastener is secured to the substrate to compress the contact against the contact pad.

5. The circuit board connector of claim 1, wherein the fastener is additionally used to secure the housing to the substrate.

6. The circuit board connector of claim 1, wherein the mounting flange and the fastener are located off of the circuit board.

7. The circuit board connector of claim 1, wherein the rear of the housing overlaps the circuit board and the front of the housing hangs off of an edge of the circuit board.

8. The circuit board connector of claim 1, wherein the main body includes a base at the rear mounted to the circuit board, the spring beam being exposed at the base for mounting to the circuit board, the wire barrel extending along a wire barrel axis, the wire barrel axis being oriented parallel to the base.

9. The circuit board connector of claim 1, wherein the main body includes a base at the rear mounted to the circuit board, the spring beam being exposed at the base for mounting to the circuit board, the wire barrel extending along a wire barrel axis, the wire barrel axis being oriented perpendicular to the base.

10. The circuit board connector of claim 9, wherein the wire barrel receives the wire from below the base.

11. The circuit board connector of claim 9, wherein the wire barrel receives the wire from above the base.

12. The circuit board connector of claim 1, wherein the housing includes an alignment element engaging the circuit board to position the housing relative to the circuit board.

13. The circuit board connector of claim 12, wherein the alignment element is a ledge extending from a base of the main body, the ledge engaging an edge of the circuit board.

14. A circuit board connector system comprising:

a circuit board having a front side and a rear side, the rear side being configured to be mounted to a mounting surface of a substrate, the front side having a contact pad, the circuit board having an LED terminated to the front side and electrically connected to the contact pad; and a circuit board connector coupled directly to the circuit board, the circuit board connector comprising:

a contact having a mating end and a terminating end, the mating end having a spring beam having a separable mating interface configured to be surface mounted to a contact pad of a circuit board, the terminating end being configured to be terminated to a wire;

a housing holding the contact, the housing having a main body extending between a front and a rear, the housing having a mounting flange extending from the main body, the main body including a contact channel holding the contact and a wire barrel at the front configured to receive the wire, the rear of the main body being positionable on the circuit board such that the spring beam of the contact is aligned with the contact pad; and a fastener coupled to the mounting flange, the fastener used to secure the housing to the substrate independent of the circuit board.

15. The circuit board connector system of claim 14, wherein the contact comprises a poke-in contact having a lance that mechanically and electrically connects to the wire.

16. The circuit board connector system of claim 14, wherein the housing is pressed against the circuit board when the fastener is secured to the substrate to compress the contact against the contact pad.

17. The circuit board connector system of claim 14, wherein the mounting flange and the fastener are located off of the circuit board.

18. The circuit board connector system of claim 14, wherein the housing includes an alignment element engaging the circuit board to position the housing relative to the circuit board.

19. The circuit board connector system of claim 14, wherein the main body includes a base at the rear mounted to the circuit board, the spring beam being exposed at the base for mounting to the circuit board, the wire barrel extending along a wire barrel axis, the wire barrel axis being oriented parallel to the base.

20. The circuit board connector system of claim 14, wherein the main body includes a base at the rear mounted to the circuit board, the spring beam being exposed at the base for mounting to the circuit board, the wire barrel extending along a wire barrel axis, the wire barrel axis being oriented perpendicular to the base.

* * * * *